United States Patent [19]

Huston

[11] Patent Number: 4,821,540

[45] Date of Patent: Apr. 18, 1989

[54] LOCK MECHANISM OPERABLE FROM ONE SIDE OF A STRUCTURE BY A PHYSICAL IDENTIFIABLE COMBINATION MECHANISM

[76] Inventor: James E. Huston, 101 Linden Dr., Galion, Ohio 44833

[21] Appl. No.: 16,800

[22] Filed: Feb. 20, 1987

[51] Int. Cl.[4] ..... E05B 13/10

[52] U.S. Cl. ..... 70/213; 292/359; 292/217

[58] Field of Search ..... 70/213, 215, 217, 289, 70/290, 133, 134; 292/358, 359

[56] References Cited

U.S. PATENT DOCUMENTS

| | | | |
|---|---|---|---|
| 2,143,419 | 1/1939 | Ladizinsky | 70/133 |
| 2,222,040 | 11/1940 | Miller | 70/213 |
| 2,308,892 | 1/1943 | Miller | 70/290 X |
| 2,919,570 | 1/1960 | Crew | 292/359 X |
| 3,006,180 | 10/1961 | Walston | 70/213 X |
| 3,107,513 | 10/1963 | Walston | 70/213 |
| 3,447,347 | 6/1969 | Kawamura | 70/213 |
| 3,785,188 | 1/1974 | Drathschmidt | 70/134 X |
| 3,800,573 | 4/1974 | Babb, Jr. et al. | 70/217 |
| 3,815,390 | 6/1974 | Stoia | 70/134 |
| 3,823,585 | 7/1974 | Spon | 292/359 X |
| 3,954,292 | 5/1976 | Johnson | 292/359 X |
| 3,967,846 | 7/1976 | Schlage | 292/359 |
| 4,055,361 | 10/1977 | Moses | 292/359 |
| 4,308,732 | 1/1982 | Hau | 70/213 |
| 4,457,147 | 7/1984 | Compston | 70/213 |

FOREIGN PATENT DOCUMENTS

| | | | |
|---|---|---|---|
| 634225 | 8/1933 | Fed. Rep. of Germany | 70/213 |
| 43869 | 9/1934 | France | 70/217 |

*Primary Examiner*—Robert L. Wolfe
*Assistant Examiner*—Suzanne L. Dino
*Attorney, Agent, or Firm*—Anthony D. Cennamo

[57] ABSTRACT

A lock system having a single direction closure comprising a permutation lock having a simplified mechanical arrangement for setting the combination for opening the closure. Upon actuation of the permutation lock, a protrusion therefrom releases a lever having a recess lock on a dog connected to the rotating spindle. The hub and spindle are severed to permit a single direction opening of the closure. The closure is reset by turning the combination knob on the permutation lock. The components are mechanically rugged and interrelated to provide the utmost in security; but yet, the minimum of inconvenience in opening.

7 Claims, 3 Drawing Sheets

LOCK MECHANISM OPERABLE FROM ONE SIDE OF A STRUCTURE BY A PHYSICAL IDENTIFIABLE COMBINATION MECHANISM

BACKGROUND

It is extemely common for commercial buildings and dwellings to have closures, such as doors, that may be opened only by key or combination lock from the outside. The security of the tenants demands appropriate selective entrance.

Such locking systems attempt to find a balance between simplicity of operation with maximum security. As in all such devices the achieving of the one is at the sacrifice of the other. The simpler the locking system for operation the simpler the locking system may be defeated. In contrast, the more complicated the locking system the more secure the locking system; but also, the more cumbersome the operation.

In those instances where maximum security is demanded, the complicated locking systems can prove to be a severe aggravation to those that use the closure. If the locking system is a key operation, the necessity of carrying an extra key can be an aggravation. If the locking system is a combination lock the setting of the lock on the precise numbers is similarly cumbersome. In many instances it is the elderly that require the maximum security; but yet, the elderly are the least capable of manipulating a complicated locking system.

It is appreciated therefore, that there is a need for such a locking system that is extemely secure; but yet, not so cumbersome that all cannot readily operate the locking system with a minimum of inconvenience.

PRIOR ART

Reference is made to U.S. Pat. Nos. 2,308,892; 2,441,895 and 2,477,892.

There is shown and described in these prior patents a permutation type of lock that is utilized as a component in the locking system combination of the preferred embodiment of the present invention. The lock of the prior art and its adaptation to the system of the present invention is described below.

SUMMARY OF THE INVENTION

The present invention comprises a lock system for a closure such as a door or the like, that permits the opening from the one side at all times and from the other side by a proper setting of a combination lock.

Although the combination lock per se does not form a part of the invention, in a preferred embodiment of the lock system the combination lock is readily adaptable to the unique latching arrangement and overall combination of components. The combination pod basically comprises a resettable number of indentations on a disc-like member. In this way, the combination is set when operated by "feel" i.e., by counting the number of rotations in both directions to the reset number as the indentations are passed over; or alternatively counting by sound as the indentations are passed over.

The several components making up the lock system are arranged in a housing in a manner wherein the action of a first component is carried through the interrelated succeeding components. A locking lever has a bar that includes a dog receiving recess and in a normal locked position the dog is retained from movement. The dog in turn is lever connected to the rotating spindle to prevent rotation unless released.

Adjacent the combination pod the lever upright portion of the locking lever is maintained in an upright position by a spring mechanism. In this position the dog receiving recess "locks in" the dog connected to the rotating spindle. The locking dog in turn prevents the door knob from rotation.

The proper setting of the combination pod does not of itself permit the opening of the closure. That is, upon the proper setting of the combination, a release tongue on the inside of the pod is pushed outwardly from the pod.

The release tongue of the combination pod overcomes the force of the spring action assembly, causing the locking lever to pivot about a certain point. This pivot uplifts the horizontal bar to relieve the locking lug from the lug retaining recess. This disengagment of the lug from the recess permits the spindle to rotate and thereby open the closure.

The door is locked by turning the combination lock knob which in turn relaxes the release tongue and the above-noted process is reversed to contain the outside half of a split spindle not allowing it to turn.

The hand setting combination lock is particularly simplified to accomodate the elderly or those that have sight difficulties; the necessity of setting the combination lock on precise numbers is alleviated; but yet, the lock system is especially rugged and does provide security far beyond that provided by the simplified locking systems.

OBJECTS

It is, accordingly, a principal object of the present invention to provide a lock system that is especially secure, but yet, readily operable with a minimum of inconvenience.

Another object of the present invention is to provide such a lock system that includes a combination lock and a latch system.

Another object of the present invention is to provide such a lock wherein the enclosure may be opened from one side at all times without the manipulation of a lock system.

A further object of the present invention is to provide a lock system utilizing in combination a pemutation type of lock that is set by "feel" or "sound" of the mechanical indentations upon rotation.

A further object of the present invention is to provide a locking system wherein the closure is locked after use by manipulation of the permutation lock.

Still other objects and features of the present invention may be readily understood upon a reading of the specification having a complete disclosure when taken in conjunction with the drawings in which:

BRIEF DESCRIPTION OF THE DRAWINGS

FIG. 4 is an exploded top view of the latching mechanism showing the split hub; whereas

DETAILED DESCRIPTION OF THE INVENTION SHOWN IN THE DRAWINGS

Figure 1:
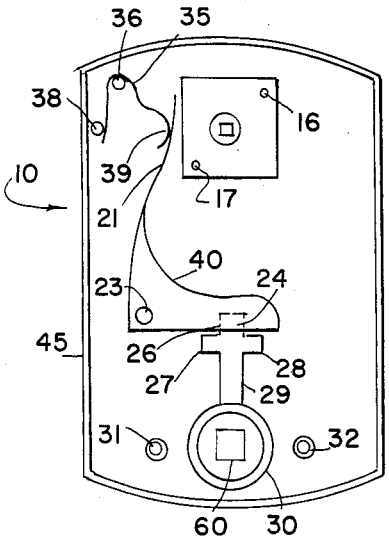
FIG. 1 illustrates the arrangement of components that make up the lock system of the present invention, in an open face view having the face plate removed from the housing, in a lock position.

With particular reference to FIGS. 1 through 4 of the drawings there is illustrated an interrelated combination of components of the lock system of the preferred embodiment of the invention.

The primary components comprises a combination pod 15, a lever 20, having a locking lug 25, a spring assembly 35, and a release tongue 40, on the permutation lock combination pod 15. The latching mechanism 50 comprises a split hub 51 and 52, and a split latching mechanism 56 and 57.

In a preferred arrangement, the components are structurally fixedly positioned within a housing 10 in an operative relationship as set forth hereinafter. The combination pod 15 is secured in position by screws 16 and 17 to pretapped holes 16a and 17a. The spindle hub 18 is aligned with the aperture 18a in the backside of the housing 10. The spindle 11 of the turning knob 12 engages the hub 18 of the pod 15. The entire combination pod 15 is mounted in a centrally/uppermost position in the housing 10.

To the left and adjacent the pod 15, is a spring assembly 35 having several standoffs 36 and 18, and a spring 35. The supported spring 35 has a curved arm 39 in a fixed relationship to the left hand wall 19 of the combination pod 15.

Adjacent the combination pod 15 and the spring 35, and extending downwardly therefrom is a locking lever 20. The vertical lever arm 21 thereof is positioned between the wall 19 of the combination pod 15 and the spring 35.

At the lowermost portion of the lever 20 is a horizontal bar 22, further including a dog or lug receiving recess 24 in the underside thereof. The locking lever 20 is pivotally positioned in the housing 10 by the pin 23 fixed thereto and extending through the aperture 23a in the locking lever 20.

A locking lug arrangement 25 is fixedly positioned on the spindle actuator 30 of the dead-latch mechanism 50. The vertically positioned locking lug 25 is directly below the lug recess 24 of the locking lever 20. The locking lug 25 comprises a lug 26 of a size and configuration substantially that of, or perhaps slightly less than of, the lug recess 24.

In a fixed horizontal position, maintained as described hereinafter, the lug 26 relative to the recess 24, the locking lug 25 further comprises a pair of shoulders 27 and 28 that abut the underside of the horizontal bar 22. A lever 29 of the locking lug 25 fixed to the spindle actuator 30 retains the position of the lug 26 relative to the position of the actuator 30.

The spindle actuator and the locking lug are fixed to the housing 10 by a retaining plate 40 which in turn is fixed to the housing by preset pins 31 and 32 joining the apertures 42 and 43 for clip retention. The aperture 41 in the plate 40 aligns with the aperture 33 in the back side of the housing. The knob 34 with the spindle support 34a is positioned in a manner for the spindle to extend through the housing to the spindle actuator 30.

Figure 4B:
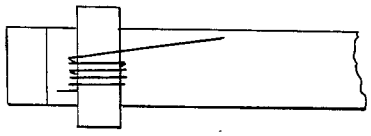
FIG. 4B illustrates the split spindle.
Figure 4:
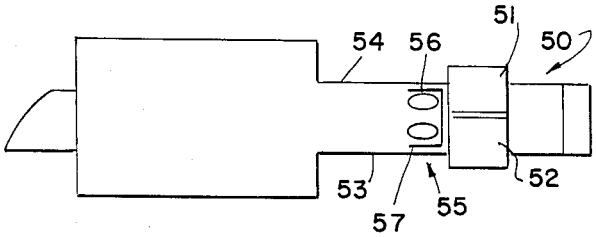
Figure 4A:
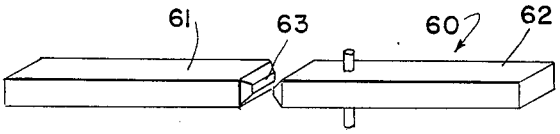
FIG. 4A is a bottom view of the split hub.
Figure 3:
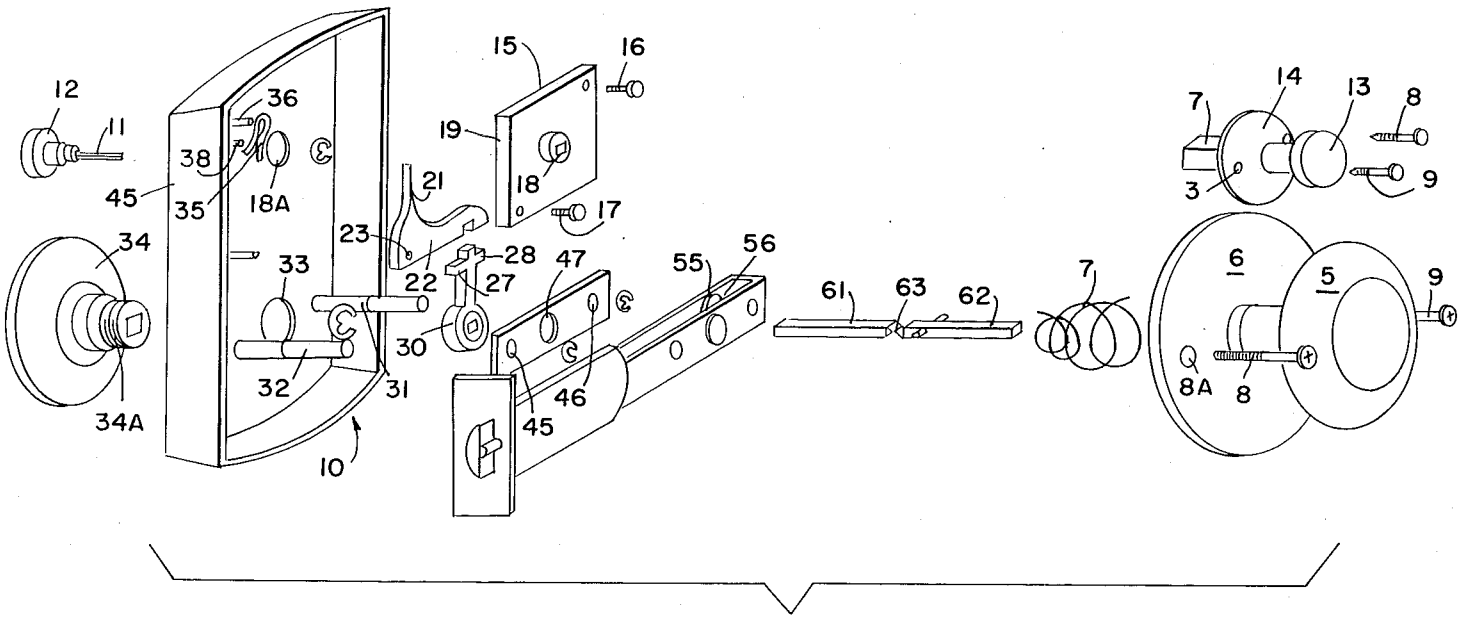
FIG. 3 illustrates, in an exploded view, the individual components of the total lock system with a correlation of parts.

With continued reference to FIG. 3 and now with reference to FIG. 4, 4A, and 4B, there is illustrated an overall view of the deadlatch mechanism 50 and an exploded view illustrating the split hubs and split actuator as utilized in the preferred embodiment. Also illustrated is the split spindle 60. The split hubs and split spindle permit the closure to be opened from one side at all times—whether the combination pod is in a locked or unlocked position.

Structurally the deadlatch mechanism 50 is a commercially available latch/spindle assembly; the mechanism being modified structurally and operatinoally to interrelate with the components that make up the overall preferred embodiment.

The hub 50 is severed into two portions 51 and 52. Similarly, the latching mechanism 55 is severed into two portions 56 and 57. The spindle is also similarly severed into two portions 61 and 62, and has positioned therebetween a set rotational retaining pin 63 to maintain the two portions 61 and 62 in their respective aligned operational positions.

The remaining structure shown in FIG. 3 is more or less conventional and is shown to complete the embodiment. The inside always opening door knob comprises a gripping portion 5, a plate 6, secured to the closure by screws 8 and 9 positioned through apertures 8a and 9a. The spring 7 is a retention spring for maintaining the spindle in proper alignment with respect to various door thicknesses.

The knob 13 is for turning the combination on the combination pod is set forth hereinafter. The protrusion 7 is of a square stock with a square broached hole in the end which slips over the spindle 11. This knob 13 is used to turn and operate the combination pod 15 from inside the closure. This total knob assembly is used to lock the assembly from the inside the closure. Also relative to the combination pod is the release tongue 40 to be better understood in the operation also set forth hereinafter.

Figure 2:
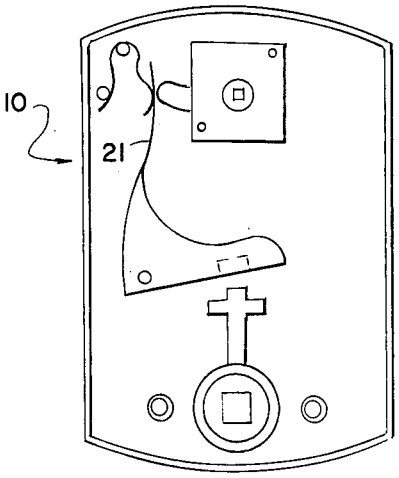
FIG. 2 illustrates the same components as shown in FIG. 1 but in this view in an unlocked position.

With reference to FIGS. 1 and 2, the preferred embodiment may be described in a first and second operational mode. The components are structurally positioned in the housing 10 as predescribed. The locking lever 20 has a lever portion thereof positioned between the spring portion 39 and the combination pod 15. The horizontal portion 22 of the locking lever is in a horizontal retained position. The lug recess has positioned therein the locking lug 26. The spindle actuator 30 is inoperative and cannot be turned.

With the combination pod 15 turned to a predetermined position as set forth herein after, reference is now made to FIG. 2.

Upon attaining the correct number of turns the release tongue 40 of the combination pod is released from the left wall of the combination pod. The release tongue 40 is so positioned relative to the upright lever 21 of the locking lever 20, that the tongue 40 physicallly contacts lever 21 and forces the lever 21 to the left; that is, the tongue 40 is of a sufficient force that the lever 21 overcomes the resiliency of the spring 35.

The movement to the left of the lever 21 causes the locking lever 20 to pivot about its pivot point 23, thereby raising the horizontal bar 22. In turn, the uplifted horizontal bar 22 releases the lug 26 from the retaining lug recess 24. The locking lug is now free and will permit rotational movement of the spindle actuator 30.

The operation of the structure of the present invention may be such that both sides of the closure remain locked until released upon the proper setting of the combination pod 15. In those instances wherein it is desired that the closure be opened from the one side whether the other side is locked or not, the latch spindle of Figure 4 is utilized, to which reference may now be had.

In operation of the latch as described relative to the prior art, the rotation of the spindle will rotate the entire hub and in turn release the latch 22. In the modified embodiment of FIG. 4, the one side of the closure will remain operational much in the same manner; the half rotated hub will release the latch. However, from the other side of the closure the hub 50 will not be operational.

In the top view of FIG. 4, it is seen the hub 50 is in two portions, split portions 51 and 52; and the latch release 55 is also in two portions, split latching mechanism 56 and 57. When the locking lug 26 is retained in the recess 24, the one half of the hub 50 will not rotate as noted above. This in turn would have prevented the operation of the locking mechanism.

In the modified embodiment of the present invention, the other half may be rotated to thereby actuate the one half of the latch release. The closure may now be opened at all times from the one side of the enclosure. The spindle severed into two portions will rotate in one or the other half at all times relative to the split hub. The other half will rotate only upon the release of the locking lug.

As aforementioned the combination pod 15 is basically that disclosed in the prior art patents, the combination pod has been modified to be adaptable and part of the combination of the lock of the preferred embodiment.

Figure 5:
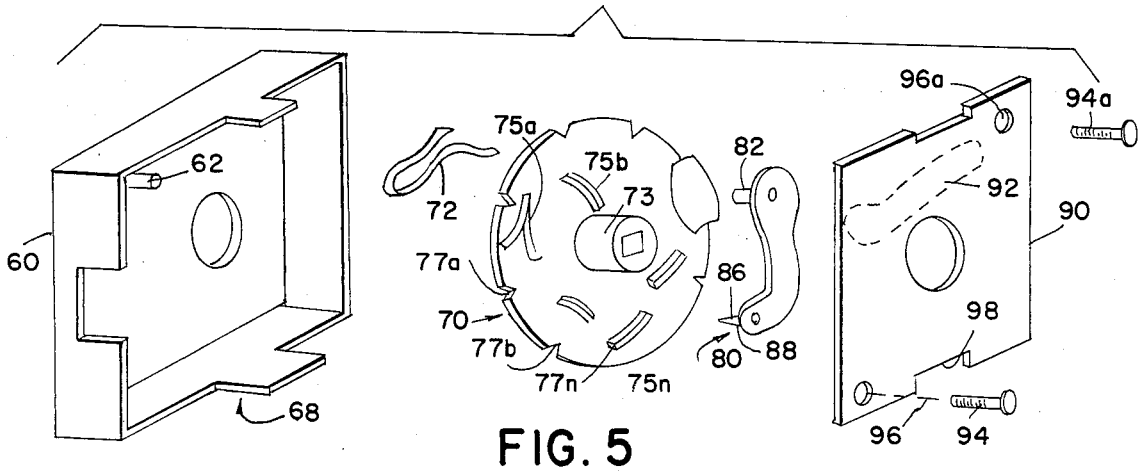
FIG. 5 illustrates in an exploded part correlation of the combination pod utilized in the preferred embodiment of the present invention.
Figure 5A:
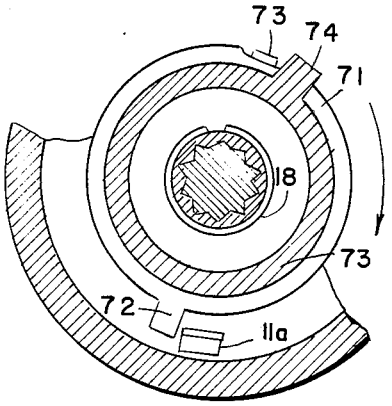
Figure 5B:
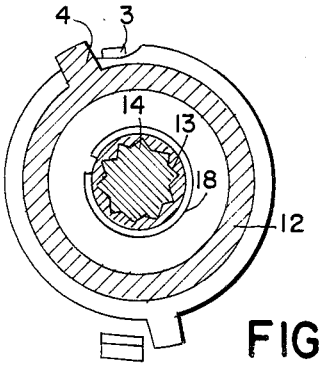
Figure 5C:
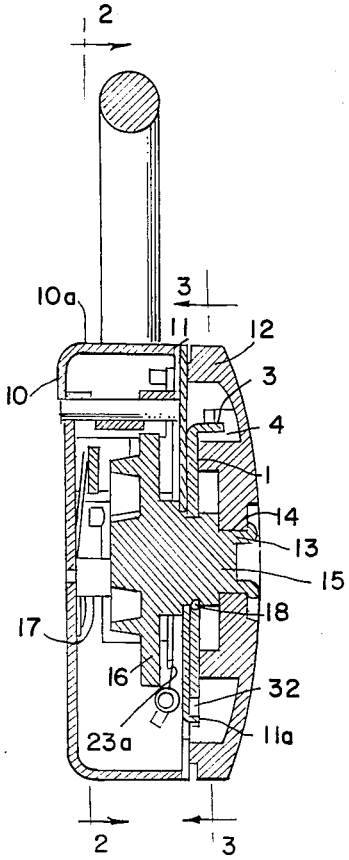

With reference to FIG. 5 there is illustrated in an exploded view the several components that make up the pod as modifed to be adaptable to the present invention. The main housing 60 has a hollow standoff 62 to accept the pivot pin 82 of the release tongue 80 the ears 68 of the housing 60 interrelates with the indentation 98 in the flat plate 90 and is bent over the indentation portion of the flat plate 90 to hold it in place.

The spring clip 72 slips over the hollow standoff 62 of housing 60 and rides against the combination disc 70. Upon rotation, as described below, the spring clicks each time it passes over a maze of notches *77a–77n* formed in the periphery of the disc 70. The combination maze of differently shaped protrusions *75a–75n* on the wall of the disc 70 determine the combination preset into the pod. The release tongue 80 includes a sharp pin-like member 88 that follows through the combination maze upon rotation of the disc 70. When the correct combination is obtained, the tongue will be forced outwardly to protrude outside of the housing 60. The protruded tongue will in turn move the locking lever as described above. The function of the combination pod is now complete.

In operation of the combination pod of FIG. 5, to unlock the combination, the knob 73 is rotated to rotate the disc 70. The disc 70 carrying the maze of protrusions, which are in reality a maze of cams *75a–75n*, engages the pin 86; that is the pin 86 follows the series of cams as the disc is rotated. When the prescribed combination is followed by turning the knob 73 to the right and then to the left, the pin 86 is worked along the cams *75a–75n* surfaces; that is, the pin follows each of the cam surfaces in engagement upon the left and right rotation of the disc. Upon attaining the proper combination, the pin 86 will reach its outermost position. At the outermost position, the nose 88 of the release tongue 80 will engage the locking lever of the locking mechanism illustrated in FIGS. 1, 2, and 3.

Although a specific embodiment has been illustrated as the preferred embodiment, it is to be understood that modifications and alternative arrangements may be had without departing from the sprit and scope of the invention.

I claim:

1. A lock mechanism for a closure utilizing a combination locking, comprising a combination pod, operable from one side of said closure by a physical identifiable combination mechanism having a tongue that protrudes upon attaining a predetermined setting thereof, a locking lever positioned adjacent said combination pod and related to the position of the tongue, said locking lever further comprises a right angle member and a horizontal member and means for pivoting said lever and horizontal member, a lug retaining recess formed on the underside of said horizontal member, a locking lug fixedly positioned relative to said lug recess, a resilient member for maintaining said locking lever and said lug retaining recess in an engaging position, to thereby prevent said lock from being operational; and a rotational spindle on said combination pod for actuation of said combination pod to a predetermined setting, a cam follower means in said combination pod operative to actuate said tongue upon said spindle attaining a predetermined setting, said tongue upon actuation protrudes to engage said right angle member and thereby pivotally moving said locking lever and thereby disengaging said locking lever retaining recess and said locking lug;

and wherein said rotational spindle further comprises a two portion member rotational from one side of said closure upon said spindle attaining a predetermined setting, and operational from the other side of said closure irrespective of the setting of said spindle.

2. The lock mechanism of claim 1 wherein said two portion spindle is comprised of a two portion rotational member, and a latching mechanism comprises of a split hub, a retaining pin joining said two portion rotational member for maintaining said spindle in aligned operational position.

3. The lock mechanism of claim 1 wherein said tongue upon protruding has a physical force greater than the resiliency of said resilient member.

4. The lock mechanism of claim 2 wherein said locking lever is maintained in an engaging position relative to said locking lug, one half of said hub will not rotate; and wherein said one half will rotate upon said locking mechanism being released.

5. A lock mechanism for a closure utilizing a combination locking mechanism, comprising a combination pod, operable from one side of a said closure by a physical identifiable combination mechanism having a tongue that protrudes upon attaining a predeterminined setting thereof, a locking lever positioned adjacent said combination pod and related to the position of said element, a lug retaining recess formed on said locking lever, a locking lug fixedly positioned relative to said locking recess, reatining means for maintaining said locking lever recess and said lug in an engaging position, to thereby prevent said lock from being operational; and means in said combination pod operative to actuate said element upon attaining a predetermined setting, said element upon actuation protruding with sufficient force to overcome said retaining means and to engage said locking lever and thereby disengaging said locking lever recess from said locking lug;

said means comprising a rotational spindle having a first and second portion and a retaining pin therebetween for maintaining said first and second portion in an aligned relationship; and a hub split into two portions interrelated with said first and second portions of said spindle.

6. The locking mechanism of claim 2 wherein said split hub other half is rotational irrespective of the position of said locking mechanism.

7. The locking mechanism of claim 5 wherein said split hub other half is rotational irrespective of the position of said locking mechanism.

* * * * *